US009724753B2

(12) United States Patent
Moschini et al.

(10) Patent No.: US 9,724,753 B2
(45) Date of Patent: Aug. 8, 2017

(54) SYSTEM AND METHOD FOR INJECTING SEMISOLID ALUMINUM INTO A MOULD

(75) Inventors: Renzo Moschini, Curno (IT); Marcello Boschini, Curno (IT); Cristian Crippa, Curno (IT)

(73) Assignee: FRENI BREMBO S.P.A. (IT)

( * ) Notice: Subject to any disclaimer, the term of this patent is extended or adjusted under 35 U.S.C. 154(b) by 473 days.

(21) Appl. No.: 14/118,253

(22) PCT Filed: May 15, 2012

(86) PCT No.: PCT/IB2012/052422

§ 371 (c)(1),
(2), (4) Date: Feb. 17, 2014

(87) PCT Pub. No.: WO2012/160479

PCT Pub. Date: Nov. 29, 2012

(65) Prior Publication Data

US 2014/0182806 A1 Jul. 3, 2014

(30) Foreign Application Priority Data

May 20, 2011 (IT) ..... MI2011A0903

(51) Int. Cl.

| | |
|---|---|
| ***B22D 17/00*** | (2006.01) |
| ***B22D 17/12*** | (2006.01) |
| ***B22D 17/20*** | (2006.01) |
| ***B22D 17/30*** | (2006.01) |
| ***B22D 17/32*** | (2006.01) |

(52) U.S. Cl.

CPC ..... *B22D 17/007* (2013.01); *B22D 17/12* (2013.01); *B22D 17/2015* (2013.01); *B22D 17/30* (2013.01); *B22D 17/32* (2013.01)

(58) Field of Classification Search

CPC ..... B22D 17/007; B22D 17/12; B22D 17/20; B22D 17/2015; B22D 17/30; B22D 17/32

USPC ..... 164/303, 312, 259, 151.4

See application file for complete search history.

(56) References Cited

U.S. PATENT DOCUMENTS

| | | | | |
|---|---|---|---|---|
| 3,954,455 | A | 5/1976 | Flemings et al. | |
| 6,808,004 | B2 | 10/2004 | Kamm et al. | |
| 6,901,991 | B2 | 6/2005 | Kamm et al. | |
| 7,441,584 | B2 | 10/2008 | Cruse et al. | |
| 2003/0037900 | A1* | 2/2003 | Winterbottom et al. | B22D 17/007 164/113 |
| 2004/0055726 | A1* | 3/2004 | Hong et al. | B22D 1/00 164/113 |
| 2011/0049197 | A1* | 3/2011 | Withey et al. | C22B 9/023 222/590 |

FOREIGN PATENT DOCUMENTS

| | | | |
|---|---|---|---|
| WO | 0005015 | A1 | 2/2000 |

OTHER PUBLICATIONS

The International Search Report and Written Opinion dated Sep. 21, 2012.

* cited by examiner

*Primary Examiner* — Kevin P Kerns
(74) *Attorney, Agent, or Firm* — Thomas | Horstemeyer, LLP

(57) ABSTRACT

A system for injecting semisolid metal into a mold, the system including a mold having a mold chamber, at least one press device having a cylinder, an injection chamber, and a thrust piston, a positioning device supporting a blending device having an active portion and a cover, and an actuating device that selectively injects the semisolid metal into the mold.

9 Claims, 9 Drawing Sheets

SYSTEM AND METHOD FOR INJECTING SEMISOLID ALUMINUM INTO A MOULD

CROSS-REFERENCE TO RELATED APPLICATION

This application is the 35 U.S.C. §371 national stage of PCT application PCT/IB2012/052422, filed May 15, 2012 which claims priority to Italian Patent Application No. MI2011A000903, dated May 20, 2011, both of which are incorporated by reference in their entirety.

The present invention relates to a system and a method for injecting metal, for example aluminum, at the semisolid state into a mould.

As is known, the need of lightening the vehicles is especially felt in the automotive field. This need must be accommodated with the contrasting need of having high quality products at competitive costs. However, the structural lightening of the vehicles is partly made useless by the continuous introduction of components installed on the vehicle for increasing the safety and the comfort thereof.

As is known, the need of reducing the vehicle consumptions in order to reduce polluting agents is strongly felt. This need is met by improving the efficiency of the engine combustion and also, above all, by introducing light materials for making the main and structural vehicle components.

Aluminum alloys represent an excellent solution thanks to their low density value, a suitable structural feature and a full recyclability thereof. However, although aluminum conversion processes, in particular smelting ones, use refined process simulation and control methodologies, actually there are no ultimate solutions to accommodate the component lightness and the high mechanical performance thereof. Known solutions, for example for aluminum conversion, for example are high pressure die casting, gravity casting and low pressure casting.

In particular, the high pressure die casting allows thin sections in the components, while not ensuring structural features that generally remain achievable only with gravity casting. However, the quality of high pressure due casting does not always achieve the desired levels due to the incorporation of air into the part thus obtained and also due to the shrinkage due to the solidification, which are particularly incident due to the solidification of the casting and the impossibility of further feeding material in the solidification step thereof.

Document U.S. Pat. No. 3,954,455, issued to Massachusetts Institute of Technology (M.I.T.), describes a method for having aluminum at the semisolid state wherein a globular microstructure is obtained in the solid phase only if the bath is kept in a vigorous stirring during the solidification, preventing the growth of the dendrites. At temperatures in the solidification range, this globular structure alloy has pseudoplastic and thixotropic properties wherein the viscosity decreases as the stirring and the stirring or mixing time increase. Such solution allows moulding by conventional deformation processes, allowing a reduction of the casting weights and thickness to be obtained.

However, while it is satisfactory under some viewpoints, such solution implies a series of passages of the metal from the smelting furnace to the mixing and cooling crucible, then into the injection container and finally in the mould, causing the forming of oxides also in the form of films, as well as the trapping of impurities that drastically deteriorate the casting quality.

Document U.S. Pat. No. 6,808,004, issued to THT Press Inc., describes the cooling of the molten metal arranged in the injection cylinder, without being stirred, but introducing additives that favor the germination of the solidification cores and thus the forming of globules rather than long dendritic branches.

Also this solution does not solve the problem of oxide formation and in particular of surface films of the metal that remains still during the partial cooling thereof, films that when injected in the mould bend, forming casting portions having a high structural discontinuity.

Document U.S. Pat. No. 6,901,991, issued to THT Press Inc., describes a solution wherein a device is provided which, once inserted into the molten metal, speeds the cooling thereof in the attempt of forming the globules in short times and such as to limit the growth of an oxide film on the metal surface, film that however is unavoidably formed.

Also this solution is particularly complex in its embodiment and unable to completely solve the problem.

Document U.S. Pat. No. 7,441,584 issued to THT Press Inc., teaches to arrange the molten metal in a chamber of a piston cylinder unit and for further shortening the semisolid moulding times, to envisage the introduction of a stirrer arranged in the proximity of the cylinder wall and of the piston bottom or crown.

Such solution leads to the introduction of a higher probability of introducing impurities into the molten metal and as clearly indicated in the description, it requires cycle time that are actually very long and unsuited for industrial systems (for example U.S. Pat. No. 7,441,584 clearly indicates optimal cycle periods of about 25 seconds).

The object of the present invention is to provide a system and a method for injecting semisolid aluminum into a mould which has such structural and functional features as to meet the aforesaid needs and, at the same time, obviate the drawbacks mentioned with reference to the prior art.

Such problem is solved by a system as well as a method disclosed herein.

Further features and advantages of the system and of the method according to the invention will appear more clearly from the following description of preferred embodiments thereof, given by way of a non-limiting example with reference to the annexed figures, wherein:

FIG. 1 schematically shows an axonometric view of a system according to a first embodiment;

Figure 1:
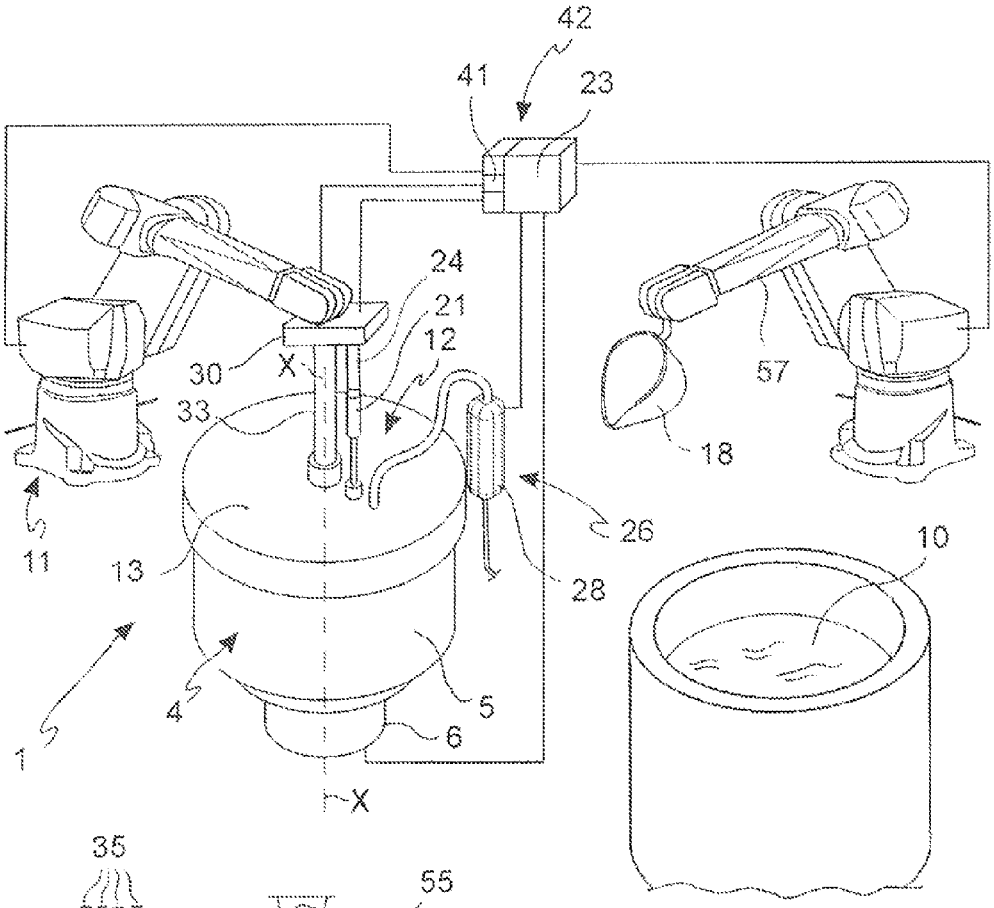
Figure 2:
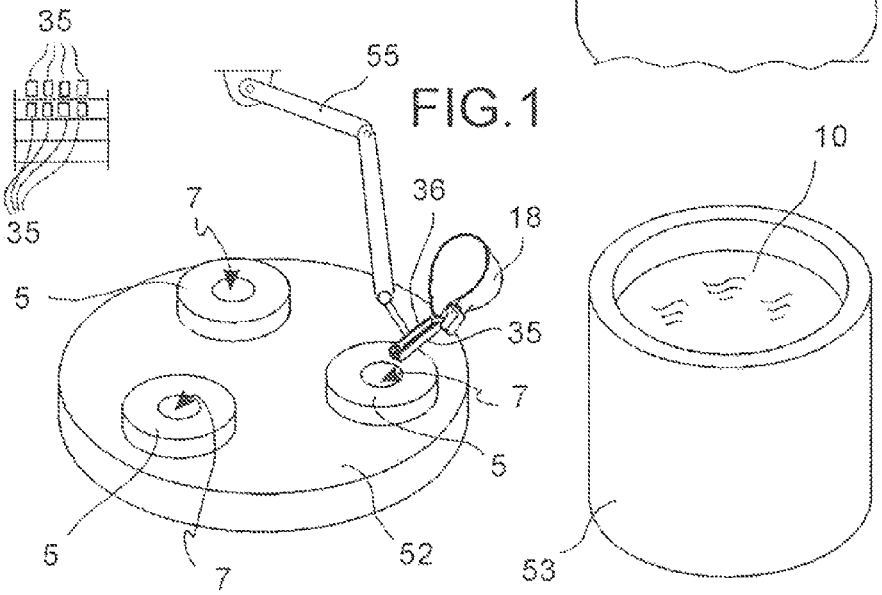
FIG. 2 shows an axonometric view of a system according to a second embodiment.
Figure 3:
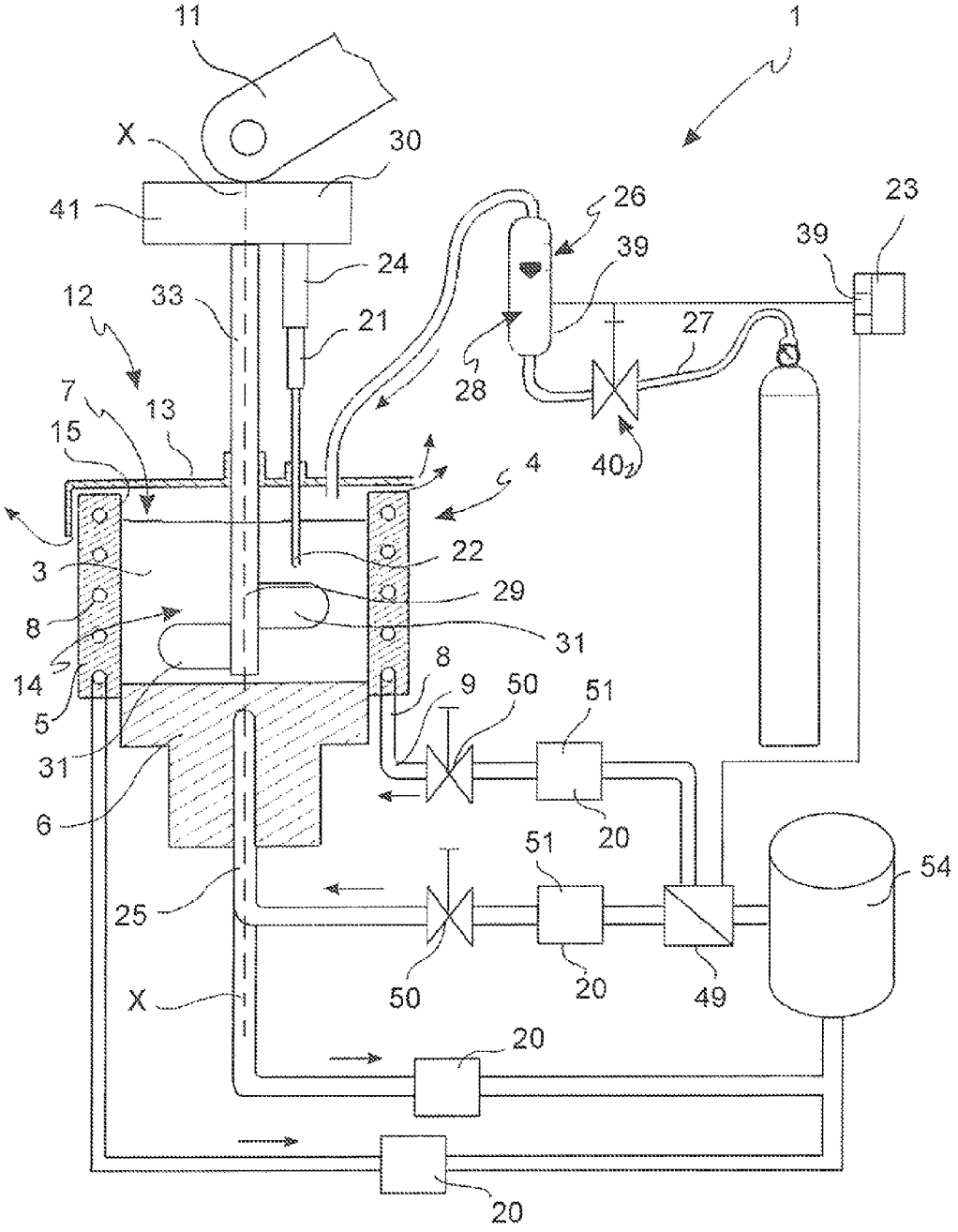
FIG. 3 shows a partial section view crosswise the injection chamber of a detail of the system of FIG. 1.
Figure 4:
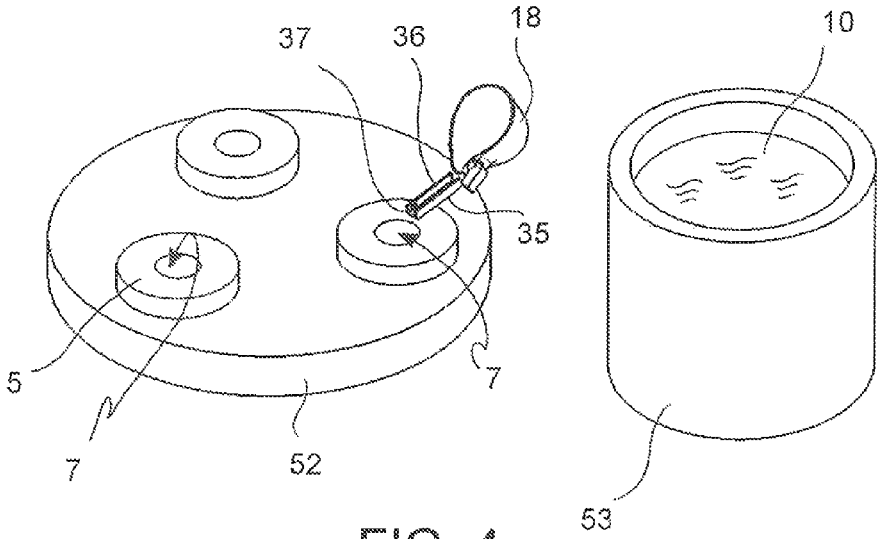
FIG. 4 shows an axonometric view of a detail of the system of FIG. 2, in particular in a use step thereof which envisages the pouring of the molten metal in the injection chamber.
Figure 5:
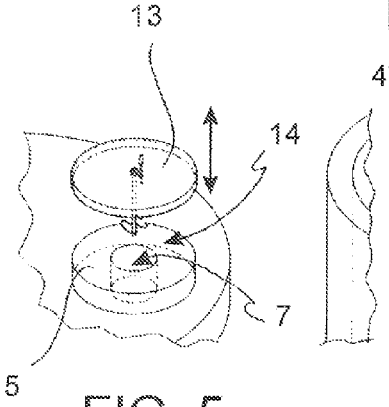
FIG. 5 shows an axonometric view of a detail of the system of FIG. 2, in particular in the injection chamber closing step.
Figure 6:
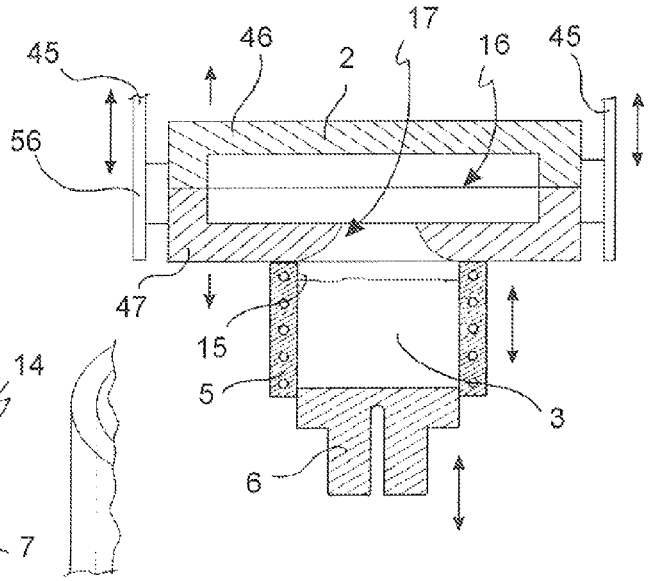
FIG. 6 shows a section view crosswise the injection chamber of a further detail of the system wherein the injection chamber is in a position coupled to a mould for injecting the semisolid metal into a mould chamber.
Figure 7:
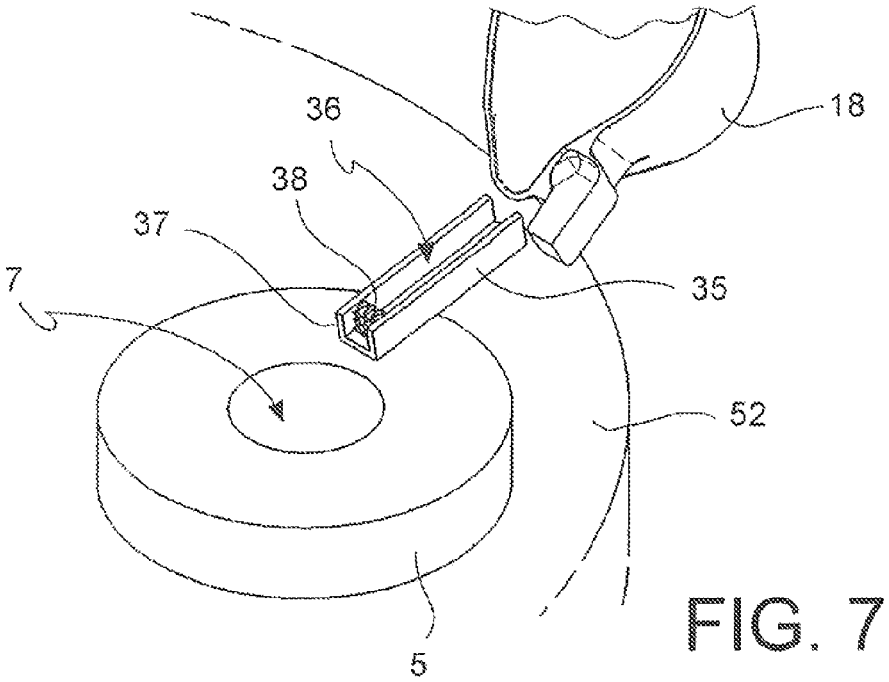
FIG. 7 shows an axonometric view of an enlarged detail of the operating step of FIG. 4.
Figure 8:
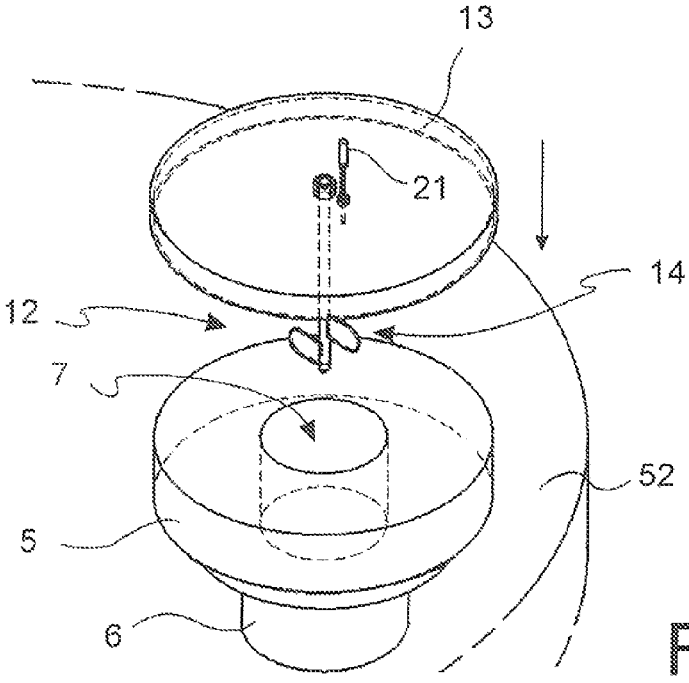
FIG. 8 shows an axonometric view of another operating step of the system of FIG. 2, wherein the injection chamber is closed by a cover while dipping a stirrer or mixer.
Figure 9:
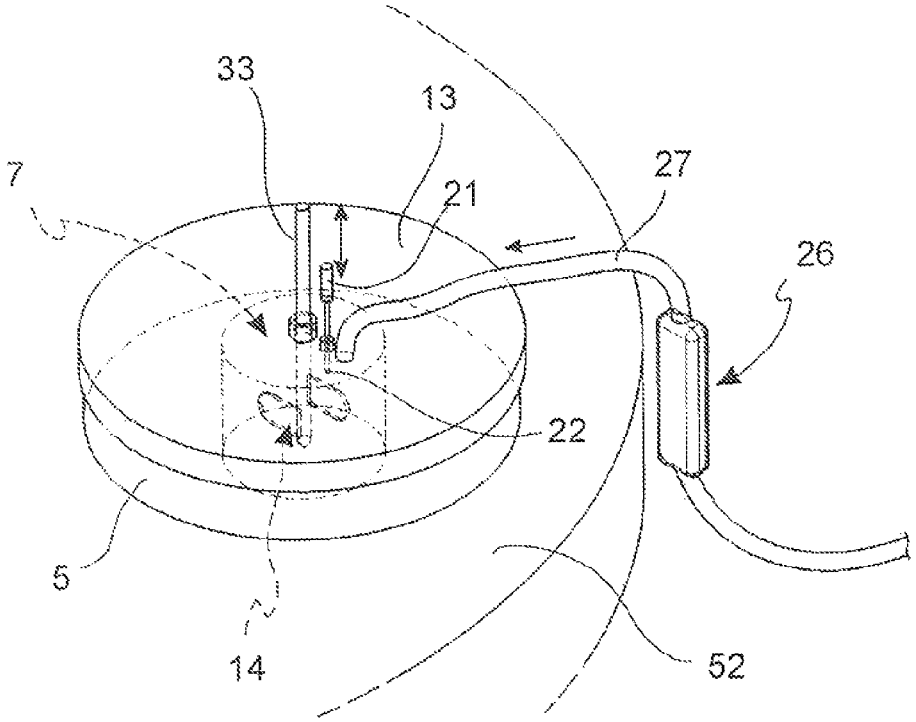
FIG. 9 shows an axonometric view of a detail of a further operating step of the system of FIG. 2, wherein the temperature of the semisolid metal is measured before, during or after the cooling and leveling/mixing thereof.
Figure 10:
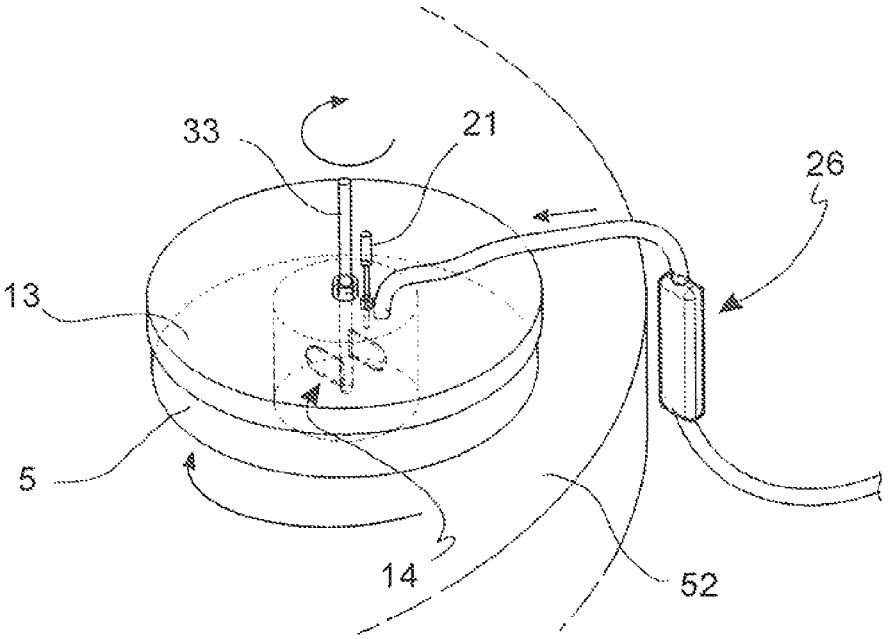
FIG. 10 shows an axonometric view of a detail of a further operating step of the system of FIG. 2, wherein the molten metal is mixed, cooled and inert gas is injected.
Figure 11:
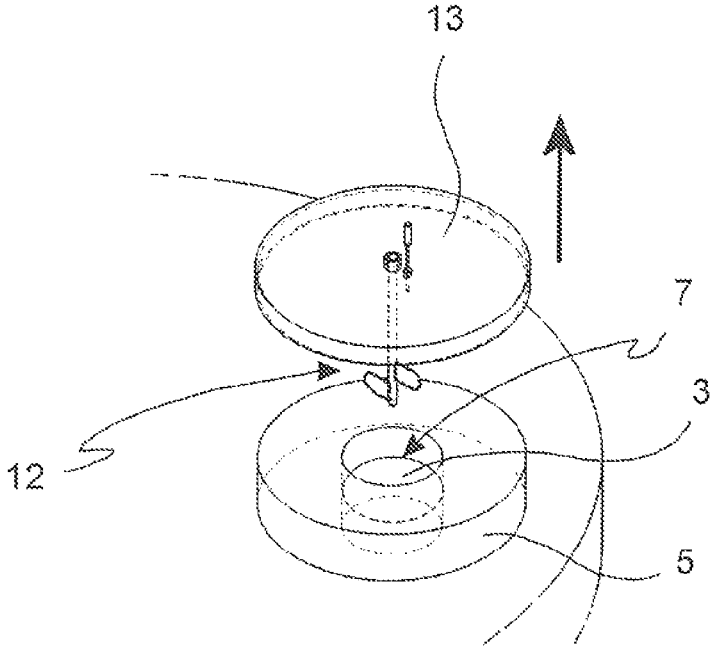
FIG. 11 shows an axonometric view of a detail of a further operating step of the system of FIG. 2, wherein the cover is lifted off the injection chamber.
Figure 12:
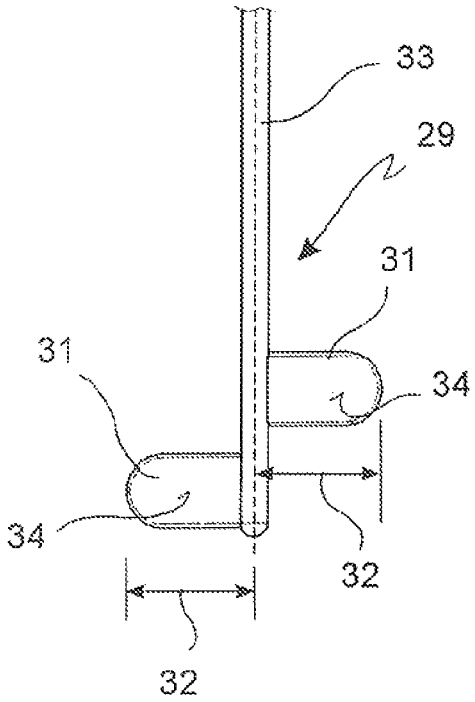
FIG. 12 and FIG. 13 show axonometric side views of some details of the system for mixing the molten or semisolid metal arranged in the injection chamber.
Figure 13:
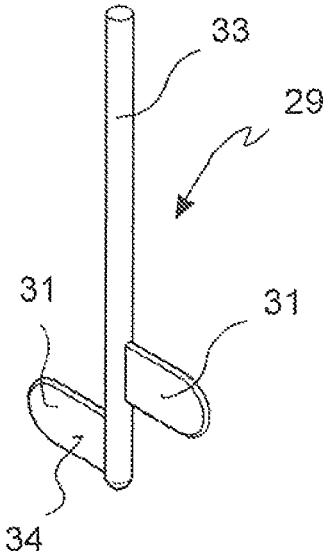
Figure 14:
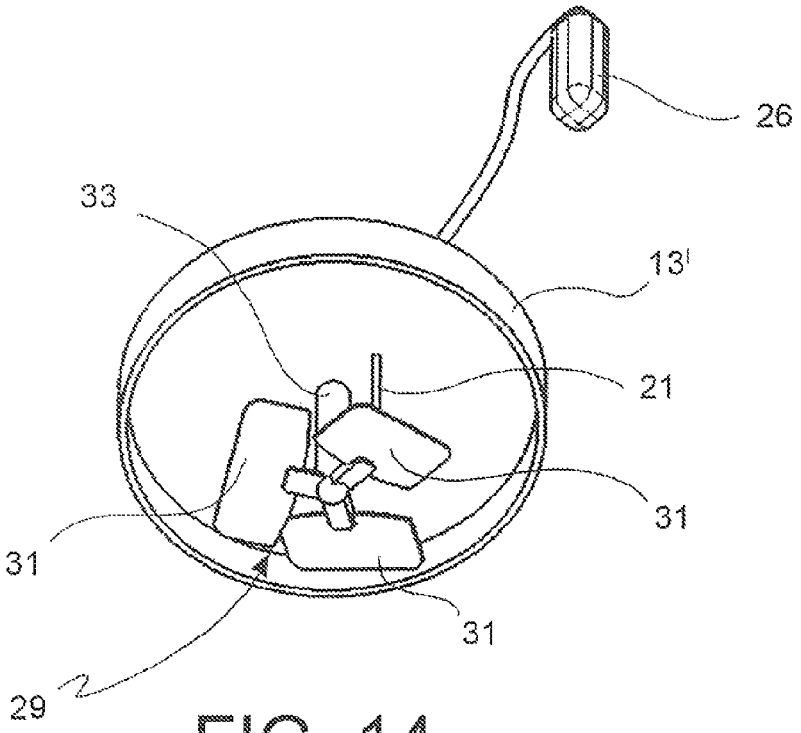
FIG. 14 shows an axonometric view of a detail according to a further embodiment of the system for mixing the molten or semisolid metal arranged in the injection chamber and closing of the same.
Figure 15:
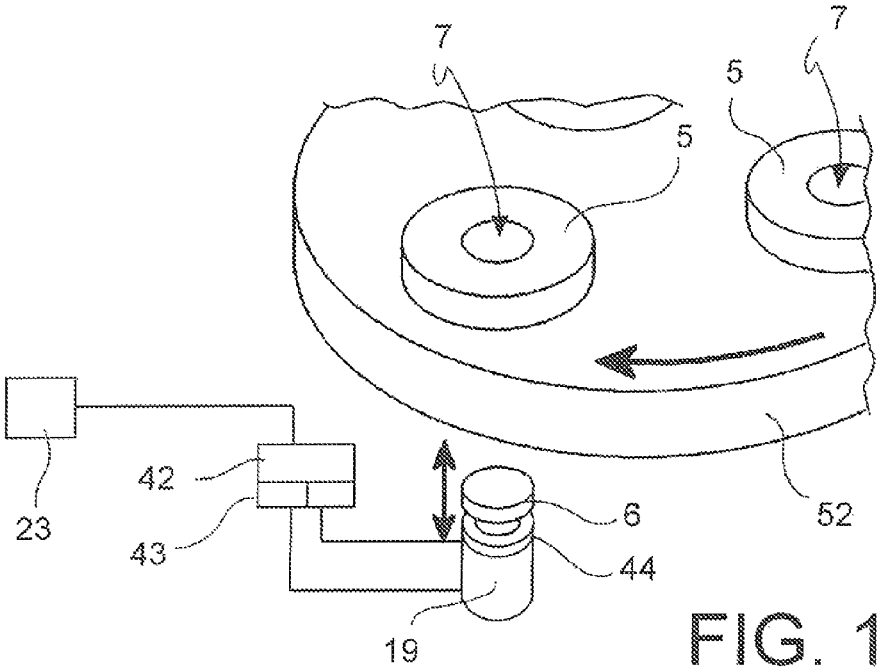
FIG. 15 shows an axonometric view of an even further detail of an operating step of the system of FIG. 2, wherein the injection chamber is approached to a mould for injecting the semisolid metal.
Figure 16:
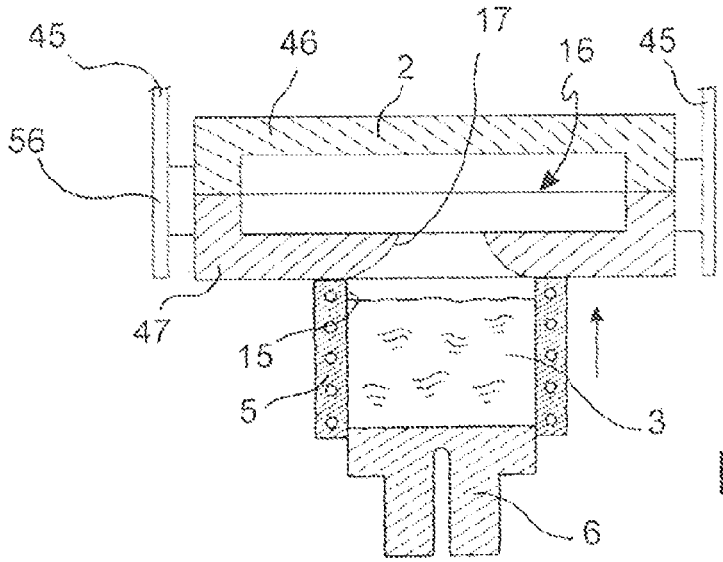
FIGS. 16, 17 and 18 show a section view of some details of the operating steps of injecting the semisolid metal into a mould.
Figure 17:
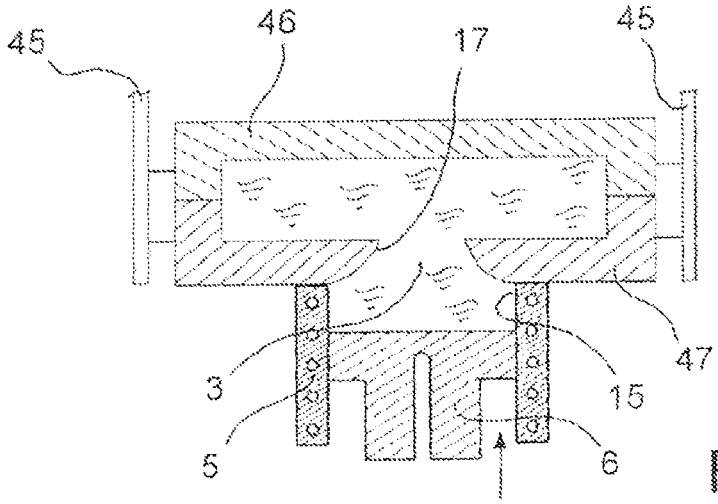

With reference to the above figures, reference numeral 1 globally denotes a system.

According to an embodiment, system 1 is a system for the injection of semisolid metal 3 into a mould 2.

According to an embodiment, said mould 2 comprises a mould chamber 16 suitable to receive the metal through a mould injection mouth 17.

According to an embodiment, said system comprises at least one press device 4 for pressure injecting metal 3 in said mould 2.

According to an embodiment, said at least one press device comprises a cylinder 5 having a substantially vertical axis X-X and a mouth 15 for coupling to the injection mouth 17 of said mould 2 as well as a thrust piston 6 accommodated within said cylinder, defining with said cylinder an injection chamber 7 suitable to contain molten metal 10.

According to an embodiment, said cylinder 5 has passageways 8 or inner ducts or a circuit of ducts to receive cooling fluid 9 capable of cooling said molten metal 10 poured into said injection chamber 7 converting it into semisolid metal 3.

According to an embodiment, a cup 18 for drawing the molten metal 10 is suitable for drawing metal and pour it into said injection chamber 7.

According to an embodiment, said system comprises a positioning device 11.

According to an embodiment, said positioning device 11 supports a blending device 12, and said blending device 12 has an active portion 14 and is associated with a hood or cover 13 suitable for closing said injection chamber 7.

According to an embodiment, said positioning device 11 is arranged to selectively position said blending device 12 with said active portion 14 within said injection chamber 7 and level the temperature of the semisolid metal 3 and simultaneously to position said hood or cover 13 to temporarily close said mouth 15 coupling the press device 4 to mould 2.

According to an embodiment, an actuating device 19 selectively acts on said thrust piston 6 to inject said semisolid metal 3 into said mould 2 when the coupling mouth 15 of the injection chamber 7 is opened and connected to the injection mouth 17 of said mould 2.

According to an embodiment, said system comprises a metal temperature detecting device 21 having an active portion 22 thereof. According to an embodiment, said metal temperature detecting device 21 is associated with said hood or cover 13 for selectively dipping the active portion 22 thereof into the molten or semisolid metal 10, 3 when the hood or cover 13 is arranged to close the mouth coupling the cylinder to mould 15.

According to an embodiment, said metal temperature detecting device 21 is connected to a control device 23 of system 1. According to an embodiment, said metal temperature detecting device 21 is connected to an actuating device 24 that moves the probe during the insertion of the temperature device 21 into the injection chamber 7 and the withdrawal of the temperature device 21 from the injection chamber 7.

According to an embodiment, said thrust piston 6 comprises passageways 25 for receiving cooling fluid 9 for cooling said molten metal 10.

According to an embodiment, said passageways 8, 25 of said cylinder and said piston are in fluid connection with a cooling circuit connected to a cooling fluid flow adjustment device and to a cooling fluid tank 54.

According to an embodiment, said cooling fluid flow adjustment device is operated in a controlled mode.

According to an embodiment, said system comprises a temperature detection device 20 for the cooling fluid 9 provided within the cooling passageways 8, 25 of cylinder 5 and/or of the thrust piston 6, preferably but not necessarily downstream of the cylinder and of the piston.

According to an embodiment, said cooling fluid temperature detection device 20 is operatively connected to a control device of the system 23.

According to an embodiment, said cooling fluid flow adjustment device is operated in a feedback controlled mode with said cooling fluid temperature detection device 20.

According to an embodiment, said hood or cover 13 is associated with a feeding device 26 of inert gas 27, such as for example but not necessarily nitrogen, into the injection chamber 7.

According to an embodiment, said inert gas feeding device 26 comprises an adjustment device 28 for the gas flow to be injected in the injection chamber 7, preferably but not necessarily operated in a controlled mode.

According to an embodiment, said blending device 12 comprises an impeller 29 having a substantially vertical X-X rotary shaft 33 and operated by a controlled actuator 30 operatively connected to a control device 23 of the system, preferably though not necessarily in a feedback mode.

According to an embodiment, said impeller 29 comprises at least one blade 31, preferably but not necessarily two blades 31. According to an embodiment, each blade 31 comprises an extension 32 substantially radial to shaft 33 and a rounded free end. According to an embodiment, said impeller 29 comprises helical blades. According to an embodiment, said impeller 29 has a surface treatment that reduces the adhesion of the molten metal 10. According to an embodiment, said impeller 29 is made of a material that reduces the adhesion of the molten metal for example though not necessarily of ceramic material.

According to an embodiment, said system comprises a filter 35 for impurities or oxides present in the molten metal 10. Said filter 35 is arranged between the cup 18 for drawing and pouring the metal 10 and the injection chamber 7. According to an embodiment, said filter 35 comprises an intake duct for the molten metal, for example an intake channel 36, which is arranged such as to receive the molten metal from cup 18 and provided with a pouring end 37 opposite to the injection chamber 7 for the molten metal to be caused to flow into chamber 7. According to an embodiment, said filter 35 has in the proximity of the pouring end 37 thereof a filter portion 38 provided with passageways suitable to retain impurities and/or oxides and cause the molten metal to flow, for example though not necessarily a filter portion 38 made from ceramic material and/or comprising silicon carbides. According to an embodiment, said filter 35 is a disposable component that can be replaced at each pour, or after a limited number thereof, of molten metal 10 into the injection chamber 7. According to an embodiment, said filter is positioned in the proximity of the injection chamber so that the cup can pour the molten metal therein through the same filter from a positioning device 55, for example a robot.

According to an embodiment, a controlled actuator 30, for example though not necessarily a feedback actuator with a temperature signal and/or a timer, controls the movements of the blending device 12.

According to an embodiment, a controlled actuator 24, for example though not necessarily a feedback actuator with a switch for closing the hood or cover and/or a switch for changing the system operating conditions, controls the movements of the metal temperature detecting device 21. According to an embodiment, a controlled actuator 39, for example though not necessarily a feedback actuator with a switch for closing and opening the hood or cover, controls the inert gas inlet device 26 within the injection chamber 7, for example, though not necessarily, it controls the adjustment of a shut-off solenoid valve 40 of the intake flow of inert gas 27.

According to an embodiment, a controlled actuator 41, for example though not necessarily a feedback actuator with a switch or timer of completed-filling of the injection chamber 7 and/or of completed-pour of the molten metal from cup 18 and/or of positioning of the press device 4 in the system, controls the positioning of the hood or cover 13 in order to either close or open the mouth 15 coupling the cylinder to mould 2.

According to an embodiment, a controlled actuator 42, for example though not necessarily a feedback actuator with a switch or timer of completed-mixing of the metal within the injection chamber 7 and/or of opening of the hood or cover 13 and/or of positioning of the press device 4 within the system, controls the positioning of the press device 4 with the coupling mouth thereof of cylinder 15 coupled to the injection mouth 17 of mould 2. According to an embodiment, a controlled actuator 42, for example though not necessarily a feedback actuator with a device for detecting the pressure exerted by the thrust piston 44, controls the forward movement of the thrust piston 6 to inject the semisolid metal 3 into the mould chamber 16 and to maintain the pressure until the metal has solidified. According to an embodiment, said mould 2 comprises several opening mould portions 46, 47 to remove the solidified piece 48. According to an embodiment, a controlled actuator 45, 56, for example though not necessarily a feedback actuator with a piston end-of-thrust switch or timer, controls the closure or opening of the openable mould portions 46, 47 for the closure to form the mould chamber 16 or for the opening to remove the solidified piece 48. According to an embodiment, a controlled actuator 49, for example though not necessarily a feedback actuator with a temperature detection device of the cooling fluid of the cylinder and/or the piston, preferably though not necessarily arranged downstream of the cylinder and/or the thrust piston, controls the splitting of a control solenoid valve 50 of the cooling fluid flow of cylinder 5 and/or piston 6. According to an embodiment, a controlled actuator 30 of the feedback blending device 12 in continuous or sample measurement or upon any change in the operating conditions of the metal temperature system.

According to an embodiment, a carousel 52 is comprised for supporting a plurality of press devices 4 with injection chambers 7 thereof formed by the relative cylinders 5 and piston 6. According to an embodiment, said stations are equally spaced and simultaneously allow to load a molten metal load, close hood or cover, cool and mix the metal until it is semisolid, and approach the mould to inject the semisolid metal.

According to an embodiment, a hood or cover 13 for a system 1 for injecting semisolid metal 3 into a mould 2 is provided, wherein said mould 2 comprises a mould chamber 16 suitable for receiving the metal through a mould injection mouth 17 and said system comprises at least one press device 4 for the pressure-injection of metal 3 in said mould 2, wherein said at least one press device 4 comprises a substantially vertical axis X-X cylinder 5 and a mouth 15 for coupling to the injection mouth 17 of said mould 2 and a thrust piston 6 accommodated within said cylinder, defining with said cylinder an injection chamber 7 suitable for containing molten metal 10, said hood or cover 13 being supported by a positioning device 11, wherein said positioning device 11 further supports a blending device 12, said blending device 12 having an active portion 14 and being associated with said hood or cover 13 and wherein said positioning device 11 being arranged for selectively positioning said blending device 12 with said active portion 14 within said injection chamber 7 and levelling the temperature of the semisolid metal 3, simultaneously positions said hood or cover 13 to temporarily close said mouth 15 coupling the press device 4 to mould 2.

A description is given below of some examples of methods for using a system for injecting semisolid metal 3 in a mould 2 wherein said mould 2 comprises a mould chamber 16 suitable for receiving the metal through a mould injection mouth 17.

According to a general embodiment, this system is used for processing semisolid metal, for example aluminium or aluminium alloy.

According to an embodiment, said system is provided with at least one press device 4 associable with said mould for pressure injecting metal 3 in said mould 2.

According to an embodiment, said at least one press device comprising a cylinder 5 having a substantially vertical axis X-X and a mouth 15 for coupling to the injection mouth 17 of said mould 2 and a thrust piston 6 accommodated within said cylinder, defining with said cylinder an injection chamber 7 suitable to contain molten metal 10.

According to an embodiment, said method comprises the steps of:

drawing molten metal 10 using a cup 18 and pouring said molten metal into said injection chamber 7;

supporting by means of a positioning device 11 a hood or cover 13 and a blending device 12 associated with said hood, positioning an active portion 14 of said blending device 12 within said injection chamber 7 and simultaneously positioning said hood or cover 13 to temporarily close said mouth 15 coupling the press device 4 to mould 2;

cooling said molten metal 10 placed within said injection chamber by means of cooling fluid 9 provided within passageways 8 to receive the cooling fluid provided within said cylinder and simultaneously mixing said molten metal 10 poured into said injection chamber 7 with said active portion 14 of said blending device 12, while said hood or cover 13 closes said mouth 15 coupling the press device 4 transforming said metal in semisolid metal 3 and levelling the temperature of the semisolid metal 3.

Then subsequently injecting said semisolid metal 3 with an actuating device 19 that selectively acts on said thrust piston 6 into said mould when the coupling mouth 15 of the injection chamber 7 is open and connected to the injection mouth 17 of said mould 2.

According to an embodiment, a further step is provided for detecting the temperature of the metal contained within the injection chamber 7. According to an embodiment, a metal temperature detecting device 21 is used, provided with an active portion 22 and the active portion 22 of the device is dipped into the molten or semisolid metal 10, 3 when the hood or cover 13 is arranged to close the mouth coupling the cylinder to mould 15.

According to an embodiment, the temperature detected of the metal contained within the injection chamber 7 is used for checking the operating steps of system 1. According to an embodiment, the temperature measurement of the metal contained within the injection chamber 7 is used to establish, when a predetermined or optimum temperature is achieved, the interruption of the metal blending and injection chamber opening step with the removal of the blending device 12.

According to an embodiment, the metal temperature is detected and the temperature is checked in order to reach a predetermined or optimum temperature by detecting the time used to blend and cool the metal to optimum condition and storing the information of the time required to blend and cool such as to be capable of using this information during successive system operating cycles thereby avoiding to use the step of detecting the temperature of the metal contained within the injection chamber at each work cycle.

According to an embodiment, the following further step is provided:

cooling the thrust piston 6 which delimits the injection chamber 7 so as to cool said molten metal 10.

According to an embodiment, a flow is adjusted of cooling fluid 9 provided within passageways 8, 25 provided within the cylinder and/or within the thrust piston. According to an embodiment, said adjustment is carried out in a controlled mode by detecting the temperature of the metal contained within the injection chamber 7. According to an embodiment, the cooling fluid flow is adjusted such that the temperature of the molten metal contained within the injection chamber 7 reaches a predefined or optimum temperature level within a predetermined or limit cycle time.

According to an embodiment, the adjustment of the cooling fluid 9 flow is carried out by detecting the temperature of the cooling fluid 9 provided within the cooling passageways 8, 25 of cylinder 5 and/or thrust piston 6.

According to an embodiment, the following further step is provided:

feeding inert gas 27 into the injection chamber 7 temporarily closed by the hood or cover. Advantageously, the inert gas 27 fed into the injection chamber 7 is nitrogen.

According to an embodiment, the gas flow 28 to be fed into the injection chamber 7 is adjusted, preferably though not necessarily so as to achieve a predetermined or optimum flow.

According to an embodiment, a further step is provided for controlling by means of a controlled actuator 30 the blending device 12 comprising an impeller 29 such as to adjust the rotation of said impeller, preferably though not necessarily in a feedback mode for example on the rotation speed of the impeller. According to an embodiment, the molten metal contained within the injection chamber 7 is blended substantially in the circumferential direction using elements transversal to the walls of cylinder 5, preferably though not necessarily by mixing along two circumferential pathways transversal to the cylinder walls and placed at two different heights relative to the bottom of the injection chamber 7 or crown of the thrust piston 6.

According to an embodiment, the metal is blended along circumferential pathways substantially transversal to cylinder 5 leaving a predetermined space between said wall of cylinder 5 and the blending device 12, and/or a predetermined space between the blending device 12 and the thrust piston 6.

According to an embodiment, there are provided the further steps of defining an optimum temperature of the semisolid metal 3 contained within the injection chamber 7, for example though not necessarily using aluminum at a temperature ranging between 580° and 600° C., preferably though not necessarily 590° C., gauging system 1 such as to have a cooling cycle time and uniformity of temperature of the semisolid metal 3 lower than a limit cycle time. In these conditions, the metal temperature; the rotation speed of the blending device 12; the optimum flow of the inert gas injected into the injection chamber 7; the optimum temperature of the cooling fluid cycling within cylinder 5 and optionally of the thrust piston 6; and/or an evaluation of the flow rate of the cooling fluid are measured.

Said cycle time is set for the system for successive working steps.

According to an embodiment, the cycle time of the blending and cooling step is recalculated only when the system parameters are changed, for example though not necessarily, using the metal temperature contained within the injection chamber and consequently by changing the blending device moving speed parameters, of the inert gas flow, of temperature or flow of the cooling fluid contained within the cylinder and/or within the thrust piston.

According to an embodiment, during the step of pouring the molten metal 10 from cup 18 to the injection chamber 7, the molten metal 10 is filtered to eliminate the impurities and/or oxides that may be present in the metal.

According to an embodiment, the metal poured from the cup into the injection chamber is filtered by means of a disposable filter, replacing said filter 35 every one or limited number or pours of the molten metal 10 into the injection chamber 7.

According to an embodiment, the molten metal is blended by controlling the blending device 12 in a feedback mode using a temperature signal of the molten metal and/or a time signal of duration of the blending step. According to an embodiment, the hood or cover is moved by operating the positioning device as a function of the operating conditions of the system, for example, though not necessarily, by means of feedback operation as a function of the temperature signal of the metal provided within the injection chamber. According to an embodiment, the feeding of inert gas into the injection chamber is controlled by controlling a splitting device for the inert gas flow by means of a positioning signal of the hood and/or cover.

The method, wherein a stepped- or station- or phased-movement of the system is provided, wherein: a first step of loading the molten metal into the injection chamber is provided;

According to an embodiment, a rotation and/or translation step is provided which shifts the injection chamber to a second station.

According to an embodiment:

a second closing step with the hood or cover of the injection chamber and starting of the simultaneous mixing and cooling of the metal contained within the injection chamber is provided.

According to an embodiment, a further step is provided for injecting inert gas into the injection chamber closed by the hood or cover.

According to an embodiment, a further step is provided for measuring the temperature of the metal contained within the injection chamber.

Subsequently, the step is provided of rotation and/or translation of the injection chamber at a further station.

the injecting action is then provided by moving the thrust piston of the injection chamber when the latter is coupled to the mould.

According to an embodiment, said stations are provided in a carrousel machine and the step is provided of moving said carrousel machine in a controlled mode, preferably though not necessarily in a feedback mode.

Below are some operating modes of the system according to the invention.

According to an embodiment, the process is divided into two macro steps:

preparation of the master alloy in a holding furnace 53 and moulding of the piece, for example a brake caliper body, by high pressure injection after creation of the semisolid material.

1. Preparation of the Master Alloy in a Holding Furnace.

a) The alloy is prepared within a furnace, for example a gas furnace, wherein the chemicals are poured according to predetermined weight proportions according to predetermined procedures (or recipes).

b) Advantageously though not necessarily, some samples of material are taken from the alloy which are subject to a chemical verification assay.

c) A certain predetermined amount of material is poured in a furnace, called holding furnace 53, in the vicinity of the final moulding station; a device is then dropped into said holding furnace which, by blowing inert gas that passes through a metal impeller, favors the separation of the impurities and of the hydrogen bubbles contained within the molten alloy coming from the smelting furnace.

d) The material inside the holding furnace on board of the machine is cleaned using special foundry tools, detaching the surface exposed to the air and therefore dirty with the impurities floated back up to the surface by the previous degassing process.

e) The material contained into the holding furnace, if deemed suitable for the requirements of control specifications in terms of density and chemical composition, is ready to be used in the next moulding step.

Figure 18:
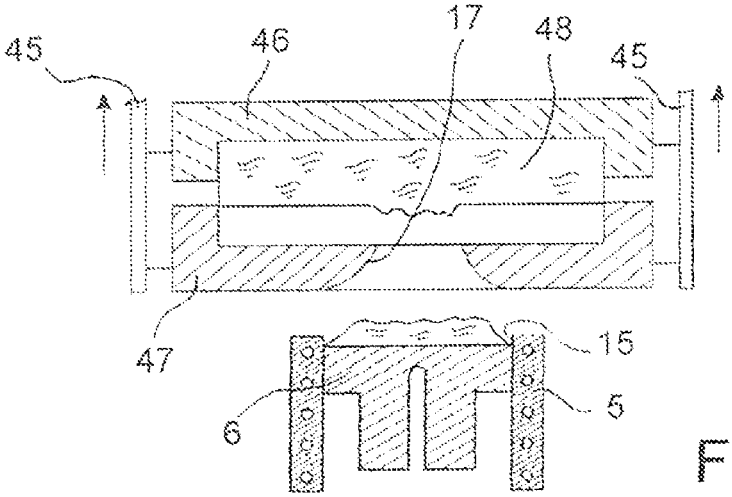
Figure 19:
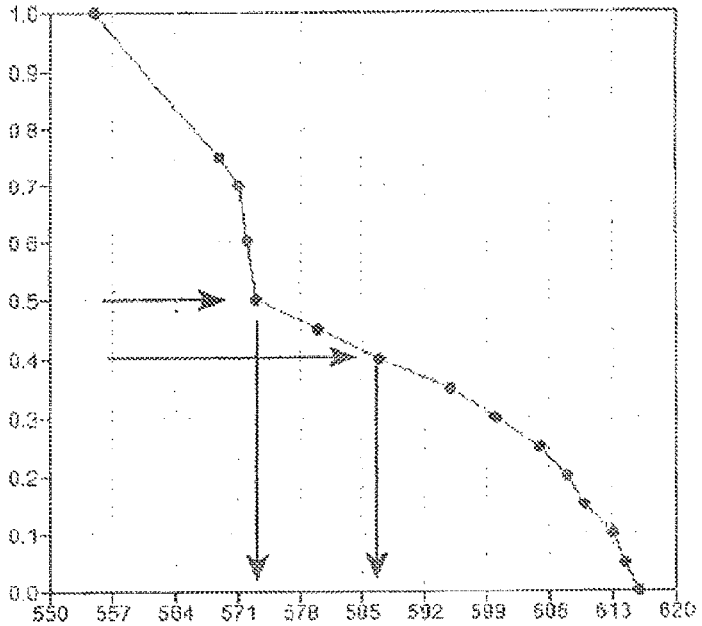
FIG. 19 shows in a Cartesian diagram showing the temperature of the semisolid metal on the abscissa and the solid metal fraction on the ordinate, a curve whereon two optimal use conditions of the system are highlighted.
Figure 20:
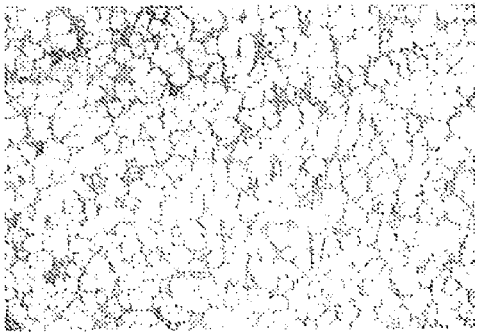
FIGS. 20 and 21 show microphotographies of the state of the material obtained with the process described herein (FIG. 20 with globular solidification), and obtained with cooling in a mould according to the prior art (FIG. 21 with dendritic solidifications).
Figure 21:
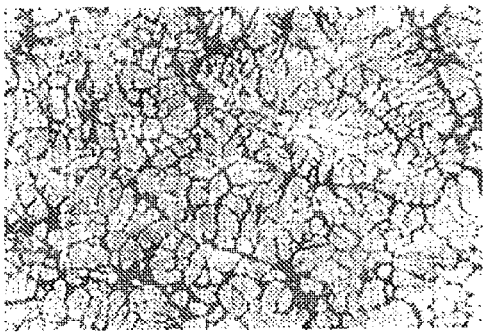

2. Moulding of the Piece, for Example a Brake Caliper Body, by High Pressure Injection after Creation of the Semisolid Material.

f) The arm of an electronically controlled hand 57, at the end thereof carrying a cup 18 of metal material coated with a protective coating or ceramic material, is approached to the holding furnace mouth, lowered by a predetermined distance and dipped into material 10 contained within the holding furnace.

g) A predetermined amount of metal enters into the cup dipped in the holding furnace.

h) Hand 57 is lifted and extending an arm thereof and/or running on a suspended rail, approaches filter 35 or device for pouring the material into the station for preparing the semisolid material. Such device consists of a channel 36 that allows the passage from the pouring cup to the injection chamber 7 or use station; a station is created at the final end thereof for seating a filter of a predetermined material, which with its presence intercepts the flow of the liquid material and retains any impurities thereof. The filter seating station is shaped so as to allow an easy replacement of the filter once that, after each cycle or a few cycles, it ends its function and must be changed; the filter may be replaced by an operator or an electromechanical feeding system 55.

i) Once the metal has been poured from the cup into the intake channel and then in the preparation station, the channel is moved away by a dedicated mechanism 55.

j) The station for preparing the metal (referred to as injection container or injection chamber 7) consists of a metal cylinder 5 the walls whereof are cooled by the circulation of heat-regulated water the temperature whereof is displayed by an electronic central unit for any checks. The container bottom consists of the crown of a hydraulic piston 6 that shall be used for moulding the caliper, as shall be described hereinafter; also the injection piston is cooled by a liquid at predetermined and displayed temperature. According to an embodiment, the container is mounted with two more containers on a metal plate (referred to as carousel 52) in positions forming angles of 120 degree.

k) A second hand 11 or robot approaches the station for preparing the semisolid metal; the mixing or blending device 12 is mounted at the end of the arm thereof integral with a metal cover or hood 13, with a station wherein a retractable thermocouple 21 is seated. The metal hood is connected to the device 26 for feeding inert gas into the injection chamber 7, for example a tube, with a flow meter and a second tube up to an inert gas distribution system: during the semisolid metal preparation cycle, the inert gas is injected in the space between the hood and the metal that must be processed. This implies the forming of an inert gas atmosphere that prevents the contact of the alloy contained into the device with the outer environment.

l) The hood is integral with a device for seating a temperature detecting system 21 (referred to as thermocouple) the end 22 whereof (hot joint) may be dipped into the material contained in the blending station. The thermocouple therefore is retractable and may be dipped in the material every moulding cycle or every given predetermined number of cycles; since it is connected to the central electronic station 23, the temperature values are stored for subsequent analyses or checks.

m) The hood is integral to a device for seating a blending system 12 for the metal contained in the station, operated by a robot 11 that rotates it on itself at a predetermined speed controlled by the central unit 23. The mechanical blending action and the cooling induced by the container favor the forming of the semisolid metal layer by the formation of a plurality of solidification cores that grow with a globular morphology also by the effect of the sliding gradient induced by the blending device.

n) The blending system 14, of pre-coated metal or ceramic material, consists of a cylindrical device or shaft 33 for fixing to the rotary shaft, whereto two flat metal devices are fixed, or blades 31, developed in horizontal direction relative to the container walls, which are vertical. The end of the two horizontal devices (referred to as blades 31) are radiused with a radius equal to half the height of the same; the two blades are integrally connected to the shaft or central shaft 33, mounted on the opposite side and at a different height.

o) As an alternative, a helical (propeller) blending device may be used.

p) Once the semisolid metal has been created, carousel 52 rotates by 120 degree and the container with the metal moves underneath the injection machine whereon mould 2 is mounted; an interlocking system lifts the container and the piston integral thereto, ensuring the perfect contact with the bottom portion of the mould q) Thereafter, the thrust or injection piston 6 is activated and lifted by such a distance as to favor the injection of the semisolid metal 3 into cavity 16 contained within mould 2; all the operations and the relative physical quantities are controlled and recorded by the electronic central unit 23 for subsequent analyses and checks.

r) Once a predetermined period of time has passed, which favors the complete solidification of the metal injected and wherein pressure is kept to the maximum value compatible with the machine potential, the upper mould 46 is lifted, dragging the caliper thus formed therewith (FIG. 18). The bottom portion of the casting (the caliper) which connects it to the metal still in the container is designed with such a geometry as to have a minimum section which during the movement of the casting dragged by the mould is torn and allows the separation between caliper and inlet channel or mould injection mouth 17. The metal portion that remains in the container remains attached thanks to the shape of the piston crown: a suitable design provides for the material-piston interface to have a "dovetail" geometry, i.e. has undercut portions that lock the material into the piston. When the piston retracts it drags the "hooked" material, the caliper is integral to the upper mould that lifts and the above minimum section tears apart, separating the caliper from the channel.

s) The casting that is still integral to the upper mould is detached thanks to the action of the mould ejectors; the operator or alternatively a robot system grips the caliper and places it in a previously determined zone.

t) The final step of the moulding cycle envisages the rotation of carousel 52 by 120 degree with the container in the last position of the carousel, where the portion of metal detached from the caliper according to what described in paragraph r) is automatically injected.

u) The moulding cycle resumes from step f).

Thanks to the proposed system and method it is possible to obtain castings free from oxides and films or impurities that create structural discontinuities.

Moreover, thanks to the system and method according to any one of the embodiments described above it is possible to obtain castings both with minimum solidification shrinkage (thanks to the moulding in semisolid phase) and free from air entrapment (thanks to the mould filling with laminar movement) so as to allow the execution of heat purification treatments thereon (without the onset of surface blisters) capable of imparting high mechanical features to the same castings.

In the practice, thanks to the system and method according to any one of the embodiments described above it is possible to obtain structural pieces having a high or very high metallurgic quality.

In particular, thanks to the provision of the hood or cover for closing the injection chamber during the cooling and blending, it is possible to ensure the exclusion of impurity entrapment. Advantageously, the injection or washing of the atmosphere of the injection chamber closed by the cover with inert gas in overpressure allows the exclusion of not only impurities but also of oxides in the semisolid metal and thus in the casting to be even more ensured during the blending of the metal in semisolid metal, also preventing the forming of dangerous films.

According to an embodiment, it has been proven that a 22 liter/min rate is optimum for washing an injection chamber having dimensions of 180 mm diameter and 150 mm depth, wherein about ⅓ volume remains as free atmosphere.

Thanks in particular to the provision of a filter between the cup and the injection chamber, for example preferably a disposable filter, it is possible to ensure the absence of oxide films that, in the chamber and in the casting, would bend on themselves, creating very harmful structural discontinuities.

Thanks to the provision of a cover for closing the injection chamber and optionally of the washing of the residual chamber atmosphere with inert gas it is possible to increase the blending speed preventing the entrapment of air into the metal and the forming of oxides and greatly reducing the semisolid forming times and thus the process cycle times. For example, in an injection chamber having dimensions of 180 mm diameter and 150 mm depth wherein about ⅓ volume is left as free atmosphere, cycle times have been obtained of about 10 seconds, maintaining an excellent metallurgic quality of the casting.

Thanks to the metal temperature measurement in the injection chamber it is possible to check the semisolid metal forming process adjusting the cycle times or other system operating parameters to obtain a metal having optimum conditions.

For example, controlling the semisolid metal temperature, even occasionally, for example when the system operating conditions change, allows the mould cavity to be fully filled allowing this method to be used also for castings with very complex shapes and/or allows the solid fraction provided in the metal to be maximized, for example achieving even 40%-50% by volume and/or allows the semisolid metal blending times to be changed according, for example, to the alloy in any case ensuring a casting with optimum metallurgic quality.

For example though not necessarily, the aluminum alloy temperature may be set to 590 degree C. and accordingly the blending cycle times and the cooling fluid flow rate may be calculated, optimizing the cycle times so that they are shorter than a predetermined limit time (for example 12 seconds).

Thanks to the systems and methods described above it is advantageously possible to obtain an optimum uniformity of the temperature in the semisolid metal mass provided in the injection chamber, ensuring an optimum casting uniformity.

Thanks to the systems and methods described above it is advantageously possible to obtain a particular promotion of the solidification cores in the molten metal, making the semisolid metal provided with a larger amount of solidified globules and with more even dimension and smaller dimensions than the known prior art methods.

It is clear that a man skilled in the art may make several changes and variations in order to meet specific and incidental needs, all falling within the scope of protection of the invention as defined by the following claims.

REFERENCES

| | |
|---|---|
| 1 | system |
| 2 | mould |
| 3 | semisolid metal |
| 4 | press device |
| 5 | cylinder |
| 6 | thrust piston |
| 7 | injection chamber |
| 8 | cooling passageways |
| 9 | cooling fluid |
| 10 | molten metal |
| 11 | positioning |
| 12 | blending |
| 13 | hood or cover |
| 14 | active portion of blending |
| 15 | coupling mouth of cylinder |
| 16 | mould chamber |
| 17 | mould injection mouth |
| 18 | metal drawing and |
| 19 | thrust piston actuator |
| 20 | cooling fluid temperature detection device |
| 21 | metal temperature detection device |
| 22 | temperature probe active portion |
| 23 | system control device |
| 24 | device for actuating and moving the temperature probe |
| 25 | passageways for cooling fluid provided in piston |
| 26 | device for feeding inert gas |
| 27 | inert gas to molten metal |
| X-X | injection chamber vertical axis |
| 28 | gas flow adjustment device |
| 29 | impeller |
| 30 | impeller control actuator |
| 31 | blade |
| 32 | blade radial extension |
| 33 | impeller shaft |
| 34 | impeller surface treatment |
| 35 | filter for molten metal impurities |
| 36 | molten metal intake channel |
| 37 | pouring end |
| 38 | filter portion with passageways |
| 39 | controlled actuator for inert gas flow |
| 40 | solenoid valve |
| 41 | controlled cover actuator |
| 42 | controlled actuator for press device |
| 43 | controlled piston thrust actuator |
| 44 | piston-exerted pressure sensor |
| 45 | mould opening closing actuator |
| 46 | opening mould portions |
| 47 | opening mould portions |
| 48 | solidified piece |
| 49 | controlled actuator for cylinder and/or piston cooling fluid flow adjustment |
| 50 | cooling fluid flow splitting solenoid |
| 51 | cooling fluid intake pump |
| 52 | carousel supporting a plurality of press device stations |
| 53 | molten metal holding furnace |
| 54 | cooling fluid tank |
| 55 | filter positioning device |
| 56 | mould opening closing actuator |
| 57 | cup handling device |

The invention claimed is:

1. A system for injecting semisolid metal into a mould, said system comprising:

a mould comprising a mould chamber suitable to receive the semisolid metal through an injection mouth;

at least one press device for pressure-injecting the semisolid metal into said mould, said at least one press device comprising a cylinder having a substantially vertical axis (X-X), an injection chamber configured to receive and contain molten metal having a mouth for coupling to said injection mouth of said mould to enable direct injection of the semisolid metal from said injection chamber into said mould, and a thrust piston positioned within said injection chamber of said cylinder configured to travel toward said mouth of said injection chamber to force the semisolid metal from said injection chamber into said mould wherein said cylinder has passageways configured to receive cooling fluid that cools the molten metal received within said injection chamber to produce semisolid metal for injection into said mould;

a positioning device supporting a blending device having an active portion and a cover, wherein said positioning device is configured to selectively move said active portion of said blending device into said injection chamber and simultaneously position said cover over said mouth of said injection chamber in order to temporarily close said injection chamber; and an actuating device that selectively drives said thrust piston to inject the semisolid metal from said injection chamber into said mould when said mouth of said injection chamber is connected to said injection mouth of said mould.

2. The system, according to claim 1, further comprising a metal temperature detecting device, which has an active portion, said metal temperature detecting device being associated with said cover to selectively dip the active portion of said blending device into the molten or semi-solid metal when the cover is arranged to close the mouth of the cylinder to the injection mouth of the mould, wherein said metal temperature detecting device is connected to a control device of the system or an actuating device that moves the metal temperature detecting device during insertion of the temperature device into the injection chamber and withdrawal of the metal temperature detecting device from the injection chamber.

3. The system, according to claim 1, wherein said thrust piston comprises passageways to receive cooling fluid for cooling said molten metal and wherein said passageways of said cylinder and said piston are in fluid connection with a cooling circuit connected to a cooling fluid flow adjustment device and wherein said cooling fluid flow adjustment device is operated in a controlled mode.

4. The system according to claim 1, further comprising a temperature detection device for the cooling fluid provided within the cooling passageways of the cylinder and thrust piston, wherein said cooling fluid temperature detection device is operatively connected to a control device and and operated in a feedback controlled mode with said cooling fluid temperature detection device.

5. The system according to claim 1, wherein said cover is associated with a device for feeding inert gas into the injection chamber, wherein said inert gas feeding device comprises an adjustment device for the gas flow to be injected into the injection chamber.

6. The system according to claim 1, wherein said blending device comprises an impeller having a substantially vertical (X-X) rotary shaft and operated by a controlled actuator being operatively connected to a control device of the system, wherein said impeller comprises at least one helical blade and each blade comprises an extension substantially radial to the shaft and a rounded free end, and wherein said impeller has a surface treatment that reduces adhesion of the molten metal and is made of a material that reduces the adhesion of the molten metal.

7. The system according to claim 1, further comprising a cup for drawing the molten metal and pouring the latter into said injection chamber and a filter for filtering impurities or oxides present in the molten metal, wherein the filter is arranged between the cup and the injection chamber and comprises an intake duct for the molten metal arranged to receive the molten metal from the cup and provided with a pouring end opposite to the injection chamber so as to cause the molten metal to flow into the chamber, wherein said filter has at the pouring end thereof a filter portion provided with passageways that are suitable to retain impurities and oxides and cause the molten metal to flow, wherein said filter is a disposable component that can be replaced.

8. The system according to claim 1, further comprising a controlled actuator that controls movements of the blending device, a controlled actuator that controls the movements of the metal temperature detecting device, a controlled actuator that controls the inert gas inlet device within the injection chamber, a controlled actuator that controls the positioning of the cap or cover in order to either close or open the mouth coupling the cylinder to the mould; and/or wherein, a controlled actuator that controls the positioning of the press device with the mouth of the cylinder being coupled to the injection mouth of the mould, a controlled actuator that controls the forward movement of the thrust piston to inject the semisolid metal into the mould chamber and to maintain the pressure until the metal has solidified, a controlled actuator that controls the closure or opening of the mould for the closure to form the mould chamber or for the opening to remove the solidified piece, and a controlled actuator that controls a solenoid valve of the cooling fluid flow of the cylinder and an intake pump of the cooling fluid flow of the cylinder.

9. The system according to claim 1, further comprising a carousel that supports a plurality of press devices each at a different station of the carousel, each press device comprising a cylinder having an injection chamber with a piston provided therein, wherein said stations are equally spaced and simultaneously allow molten metal to be loaded, the cover to be closed, and metal to be cooled and mixed until it is semi-solid.

* * * * *